US007297888B2

(12) United States Patent
Kovacic et al.

(10) Patent No.: US 7,297,888 B2
(45) Date of Patent: Nov. 20, 2007

(54) FOOD SLICER WITH A SAFETY SWITCH

(75) Inventors: Peter Kovacic, Gomilsko (SI); Aleksander Sedovsek, Mozirje (SI)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 565 days.

(21) Appl. No.: 10/928,221

(22) Filed: Aug. 27, 2004

(65) Prior Publication Data

US 2005/0045010 A1 Mar. 3, 2005

Related U.S. Application Data

(63) Continuation of application No. PCT/EP03/01755, filed on Feb. 20, 2003.

(30) Foreign Application Priority Data

Feb. 27, 2002 (DE) ..... 102 08 491

(51) Int. Cl.
*H01H 1/52* (2006.01)
*H01H 3/20* (2006.01)

(52) U.S. Cl. ..... 200/321; 200/43.18; 200/43.13; 83/478; 83/717

(58) Field of Classification Search ..... 200/43.01, 200/43.06, 43.07, 43.12, 43.13, 43.18, 43.11, 200/334, 318.1, 321; 83/452, 458, 399, 421, 83/425, 397, 478, 717
See application file for complete search history.

(56) References Cited

U.S. PATENT DOCUMENTS

| | | | | |
|---|---|---|---|---|
| 3,704,736 | A * | 12/1972 | Pratley | 83/397 |
| 4,097,705 | A * | 6/1978 | Harvell | 307/126 |
| 4,499,804 | A * | 2/1985 | Takeda | 83/399 |
| 5,720,096 | A * | 2/1998 | Dorsey | 29/559 |
| 6,244,153 | B1 * | 6/2001 | McInnes et al. | 83/870 |
| 6,595,444 | B2 * | 7/2003 | Schwelling | 241/37.5 |

FOREIGN PATENT DOCUMENTS

| | | |
|---|---|---|
| DE | 26 01 269 A1 | 7/1977 |
| DE | 27 33 706 A1 | 2/1979 |
| DE | 39 02 964 C1 | 7/1990 |
| DE | 199 60 267 A1 | 7/2000 |

* cited by examiner

*Primary Examiner*—Richard K. Lee
(74) *Attorney, Agent, or Firm*—Russell W. Warnock; Craig J. Loest; James E. Howard

(57) ABSTRACT

A food slicer has a housing with a first push-button for actuating an electric switch for operating the cutting blade and a second push-button, i.e., a safety button, locking the first push-button against actuation. The second push-button actuates a mechanical lock which can be engaged and disengaged, blocking the first push-button in an inserted position of the lock, thereby preventing actuation of the electric switch that triggers an electric motor drive used to actuate a circular cutting blade. The first push-button is formed with a stop surface for the lock on which the lock is arranged, when it is in an inserted position, either at or in close vicinity of an axis extending through the center of the push-button surface, pointing in the direction of actuation, and on which the lock engages in an inserted position.

17 Claims, 4 Drawing Sheets

FOOD SLICER WITH A SAFETY SWITCH

CROSS-REFERENCE TO RELATED APPLICATION

This is a continuing application, under 35 U.S.C. § 120, of copending international application No. PCT/EP03/01755, filed Feb. 20, 2003, which designated the United States; this application also claims the priority, under 35 U.S.C. § 119, of German patent application No. 102 08 491.2, filed Feb. 27, 2002; the prior applications are herewith incorporated by reference in their entirety.

BACKGROUND OF THE INVENTION

FIELD OF THE INVENTION

The invention relates to a slicer, such as a food slicer. The device has a housing with a first push button which has a key surface for operation of an electrical switch, and with a second push button for operation of a lock that can be pushed in and out mechanically and blocks the first push button when the lock is in the pushed-in position, thus preventing operation of the electrical switch. The switch turns an electrical drive motor on and off. The electrical drive motor is used to drive a circular cutting blade.

German published patent application DE 26 01 269 A1 discloses a household slicing machine, which has a blade that is in the form of a circular disk and is driven by an electric drive motor such that it rotates, in the circuit of which drive motor a switch is provided, and which machine has a mechanical lock, which can be pushed in and out, and which prevents the switching contacts of the switch from being closed when it is in the pushed-in position. It is possible to provide for the lock to automatically assume its pushed-in position after each occasion on which the motor is switched off. The automatic movement of the lock back to its pushed-in position is normally achieved by a helical spring made of spring steel, which is inserted between the lock and the housing of the household slicing machine. The known design has the disadvantage that the additional helical spring must be installed in an elastic prestressed manner during the assembly process. Since both the switch and the lock must be coupled to one another during the assembly process, and the prestressed helical spring must be inserted between the lock and the housing at the same time, the assembly process is complicated and involves a large amount of effort.

SUMMARY OF THE INVENTION

It is accordingly an object of the invention to provide a food slicer and an electrical switch safety system which overcomes the above-mentioned disadvantages of the heretofore-known devices and methods of this general type and which provides for a food slicer having an electrical switch and a lock which can be pushed in and out, and which ensures reliable operation of the lock and of the switch. A further object is to provide a switch/lock safety configuration which can be installed in a simple manner. It is yet a further object of the invention to provide a food slicer that can be produced at low cost.

With the foregoing and other objects in view there is provided, in accordance with the invention, a slicer, comprising:

a housing, an electric drive motor for driving a cutting blade of the slicer;

a first push button mounted to said housing, said first push button having a key surface for operation of an electrical switch for selectively turning on and off said drive motor, having a stop surface, and defining an operating direction with an operating axis intersecting a centroid of said key surface;

a lock disposed to move between a locking position, in which said lock engages said stop surface at or in a vicinity of said operating axis and blocks said first push button for preventing an operation of said electrical switch, and an operating position in which said first push button is not blocked; and a second push button mounted to said housing and operatively connected to said lock, for selectively moving said lock into said locking position for blocking said first push button.

The above objects are achieved by the novel food slicer. Since the lock acts very centrally under the key surface of the electrical switch, this ensures that the lock makes reliable contact. Any tilting of the switch if it is not operated centrally is not transmitted to the lock. It is therefore less easy for the lock to become hooked on the switch, and the lock can be operated reliably.

In one advantageous refinement, an elastic spring element which prestresses the push button against its operating direction can be integrally formed on the push button, simplifying the assembly of the food slicer. The fact that the elastic spring element is integrally formed on the push button also reduces the range of parts, and the food slicer can thus be produced at lower cost.

In one advantageous refinement, the first push button, which is used to operate the electrical switch, has a guide element, by means of which the first push button is guided in a guide seat on the housing between a switched-on position and a switched-off position, and a first end of the first elastic spring element is attached to the guide element, and a second end of the first elastic spring element is attached to the housing. This refinement allows the first push button to be prestressed against its operating direction in the housing without any additional components being required for prestressing. The first push button, which is designed to be sprung in this manner, can thus be attached to the housing in a simple manner. There is no need to insert a separate elastic spring element, and there is no longer any need for attachment by means of additional attachment means.

The first end of the first elastic spring element is preferably integrally formed on the guide element, and the second end of the first elastic spring element has a nipple which is held in a mating piece on the housing. The nipple and mating piece in this case form the attachment means, which fixes the first elastic spring element on the housing.

In one preferred refinement, the housing has a first holder into which the first push button can be inserted from the outside via a first opening in the housing, with the first push button having a latching means which engages behind the first opening and rests on an inner face of the housing. During assembly, the first push button, on which the first elastic spring element is integrally formed, is first of all inserted from the outside into the opening in the housing, until the latching means on the first push button have passed through the first opening, and have spread apart on the inside of the housing, where they come to rest. The first push button can thus be fixed to the housing simply by pushing it in.

It is particularly advantageous for the first holder to have a seating surface, which has the guide seat and the mating piece. With this embodiment, assembly is carried out by insertion of the guide element of the first push button into the guide seat on the housing. The first push button is pushed into the guide seat until the latching means on the first push button engage behind the opening and rest on the inside of the housing, such that they are fixed. At the same time, the nipple on the second end of the elastic spring element latches into the mating piece on the seating surface of the first holder. The elastic spring element is fixed to the housing by the nipple latching in the mating piece. This embodiment has the advantage that the assembly step of attachment of the first push button to the housing at the same time results in the elastic spring element being attached to the housing. The elastic spring element is prestressed by the first push button being pushed into the guide seat on the seating surface of the first holder.

The mating piece may be in the form of a cutout in the seating surface, of such a size that the first elastic spring element can be passed through the cutout from the outside, and such that its cross section is smaller than the cross section of the nipple. If the mating piece is designed to have suitable dimensions, the integral component comprising the first push button and the first elastic spring element can very easily be inserted into the housing from the outside via the opening, and can be attached to the first holder.

The guide seat and the mating piece may be directly integrally formed on the seating surface. This is particularly advantageous when the housing is composed of plastic and is produced using the injection-molding method. The seating surface, the guide seat and the mating piece may in this case be manufactured in one process, specifically during the injection molding of the housing. This has the advantage that it reduces the number of parts in the food slicer. The food slicer can thus be produced at low cost.

In one preferred refinement, a second elastic spring element, by means of which the second push button is prestressed into the pushed-in position, is also integrally formed on the second push button, in addition to the first push button. The second push button, which operates the lock which can be pushed in and out mechanically, may, in an analogous manner to the first push button, have an integrally formed second elastic spring element, by means of which the second push button is prestressed into the pushed-in position. The transmission for the solutions according to the invention for the first push button, which operates the electrical switch for the drive motor for the food slicer, can be applied in an analogous manner to the second push button, which operates the lock which can be pushed in and out mechanically. For this purpose, a first end section of the second elastic spring element may be integrally formed on the second push button, and a second end section may be supported on the housing.

In one advantageous refinement, the first end section of the second elastic spring element is integrally formed on the second push button, and a second end section is not supported on the housing, but is supported on the guide element of the first push button. The opposing bearing for the second end of the second elastic spring element is thus not arranged directly on the housing, but is located on the first push button, which is attached to the housing by means of the guide seat. This has the advantage that no additional opposing bearing for the second elastic spring element need be provided on the housing. Since the opposing bearing for the second elastic spring element is provided on the first push button, the housing can be designed in a simpler manner.

In one preferred refinement, the lock is in the form of a bolt, which is integrally formed on the second push button and by means of which the guide element for the first push button is blocked when the second push button is in the pushed-in position. The bolt in this case forms the lock which can be pushed in and out, and which is integrally formed directly on the second push button. The second push button and the lock which can be pushed in and out mechanically are thus in the form of a single part. This has the advantage that the number of parts is reduced further. In particular, assembly of the food slicer is also simplified.

In a further variant, the second push button is mounted in the housing such that it can pivot, and the lock is in the form of a lever which is integrally formed on the second push button and engages in a groove on the guide element when in the pushed-in position. This configuration allows the lock to be pushed in and out by means of a pivoting movement. The use of a lever which can pivot and which engages in a groove on the guide element of the first push button when it is in the pushed-in position allows the lock on the first push button to be released with little force being applied.

In one preferred refinement, the housing has a second holder, into which the second push button can be inserted from the inside via a second opening in the housing, and the second opening or the second push button has a step against which the second elastic spring element prestresses the second push button into the pushed-in position.

In one particularly advantageous refinement, the first push button and the second push button are produced as an integral plastic injection-molded part. The first push button and the second push button are in this case produced from the same plastic material. The integral production of the first push button with the second push button reduces the production costs, since there is no longer any need for two different injection-molding injection molds to produce the push button, and only a single mold is required. The second push button and the first push button can be separated from one another once they have been produced, and can be installed individually on the housing of the food slicer, or the first and the second push button can be installed jointly as an integral basic injection-molded part in the housing of the food slicer.

If the first opening on the housing has a larger cross section than the operating surface of the second push button, that end of the component which is produced integrally as a basic injection-molded part and has the first push button and the second push button which has the second push button can be inserted first of all during the assembly process through the first opening in the housing in advance, until the first push button is fixed on the housing. Once the first push button has been mounted on the housing, the second push button can be separated from or broken off the first push button, and can be inserted into the second holder from the inside via the second opening in the housing, until the second push button is fixed in the housing. This has the advantage that the first and second push buttons can be installed jointly on the housing, in one operation.

In a further advantageous refinement, that end of the guide element which is opposite the operating surface of the first push button is in the form of a bearing sleeve, and the second end section of the second spring element is in the form of a bearing journal. During the production of the first and of the second push button as an integral plastic injection-molded part, knock-out webs, which connect the first and the second push button, are then integrally formed between the bearing sleeve and the bearing journal. If this composite component is now inserted with the second push button in advance into the first opening in the housing, the first push button can first of all be latched to the housing. During the subsequent assembly step, the second push button is rotated about the bearing journal, until the knock-out webs between the bearing sleeve and the bearing journal break, and release the second push button from the first push button. The second push button can be pivoted and can be inserted from the inside into the second opening in the housing, with the second push button being attached to the housing. Despite the knock-out webs being broken, the second push button is connected to the first push button by means of the bearing journal, which is still guided in the bearing sleeve. The design of the first push button and of the second push button according to the invention considerably simplifies the assembly process, and the production costs are considerably reduced because the number of parts is reduced.

Other features which are considered as characteristic for the invention are set forth in the appended claims.

Although the invention is illustrated and described herein as embodied in a food slicer with a safety switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
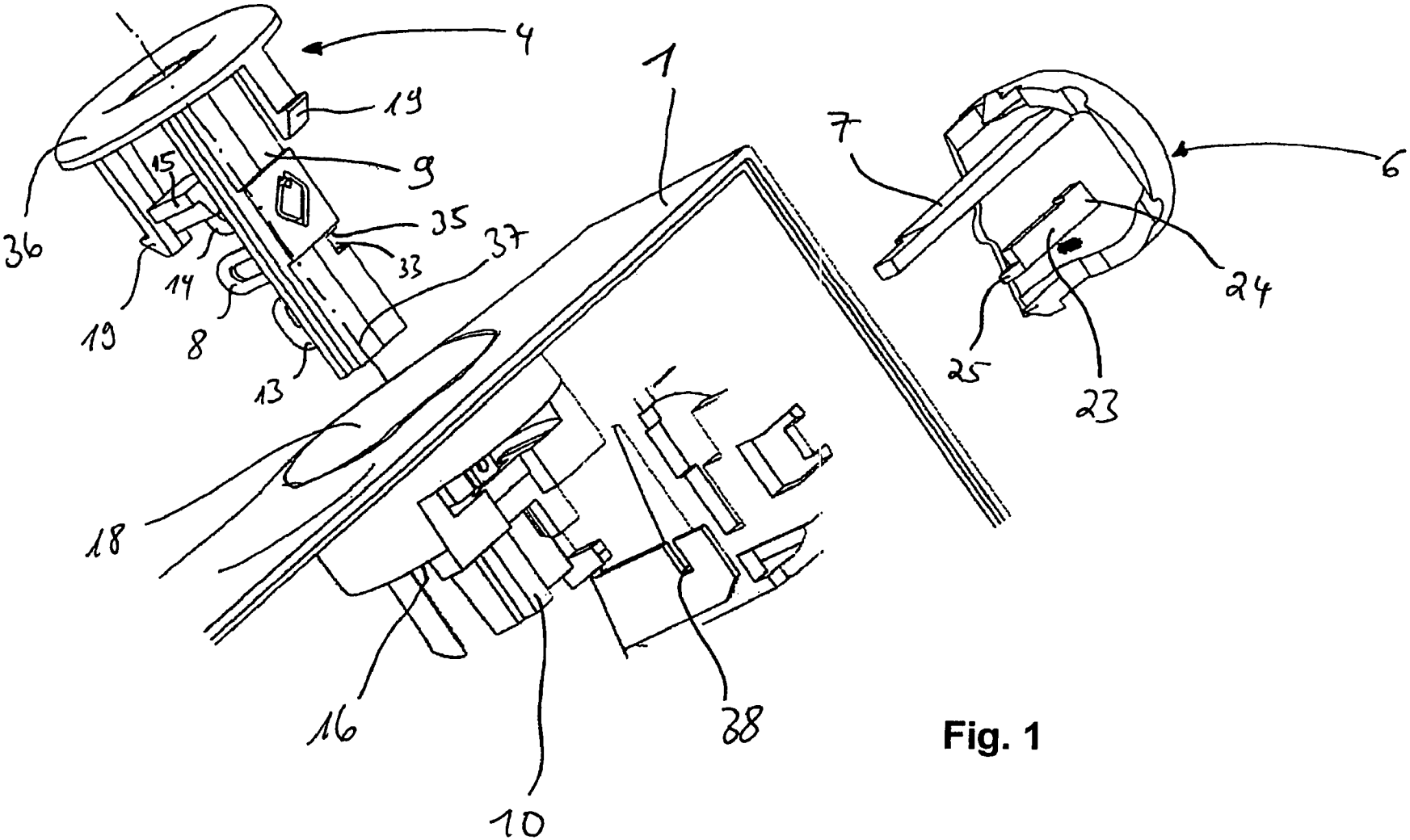
FIG. 1 is an exploded perspective view of a switching push button and of a push button lock for a slicer according to the invention.

Referring now to the figures of the drawing in detail and first, particularly, to FIG. 1 thereof, there is shown a first push button 4 with a key surface 36. A guide element 9 is integrally formed on the lower face of the key surface 36, and extends at right angles downwards along an axis 37. A stop surface 35 is provided in the central area of the guide element 9 and is located on a covering surface of a notch on the guide element 9. A lock 7 rests on the stop surface 35 when in the pushed-in position. The guide element 9 is mounted on the housing 1 such that it can move in a guide seat 10. The key surface 36 has two latching means 19 or snap hooks 19, which engage in the opening 18 in the housing 1. The first end 13 of an elastic spring element 8 is integrally formed on the guide element 9. A second end 14 of the elastic spring element 8 has a nipple 15, which is held in a mating piece 16 that is integrally formed on the housing 1.

The lock 7 is integrally formed on a second push button 6. The push button 6 also has a second elastic spring element 23. A first end section 24 of the second elastic spring element 23 is integrally formed on a lower face of the second push button 6.

Figure 2:
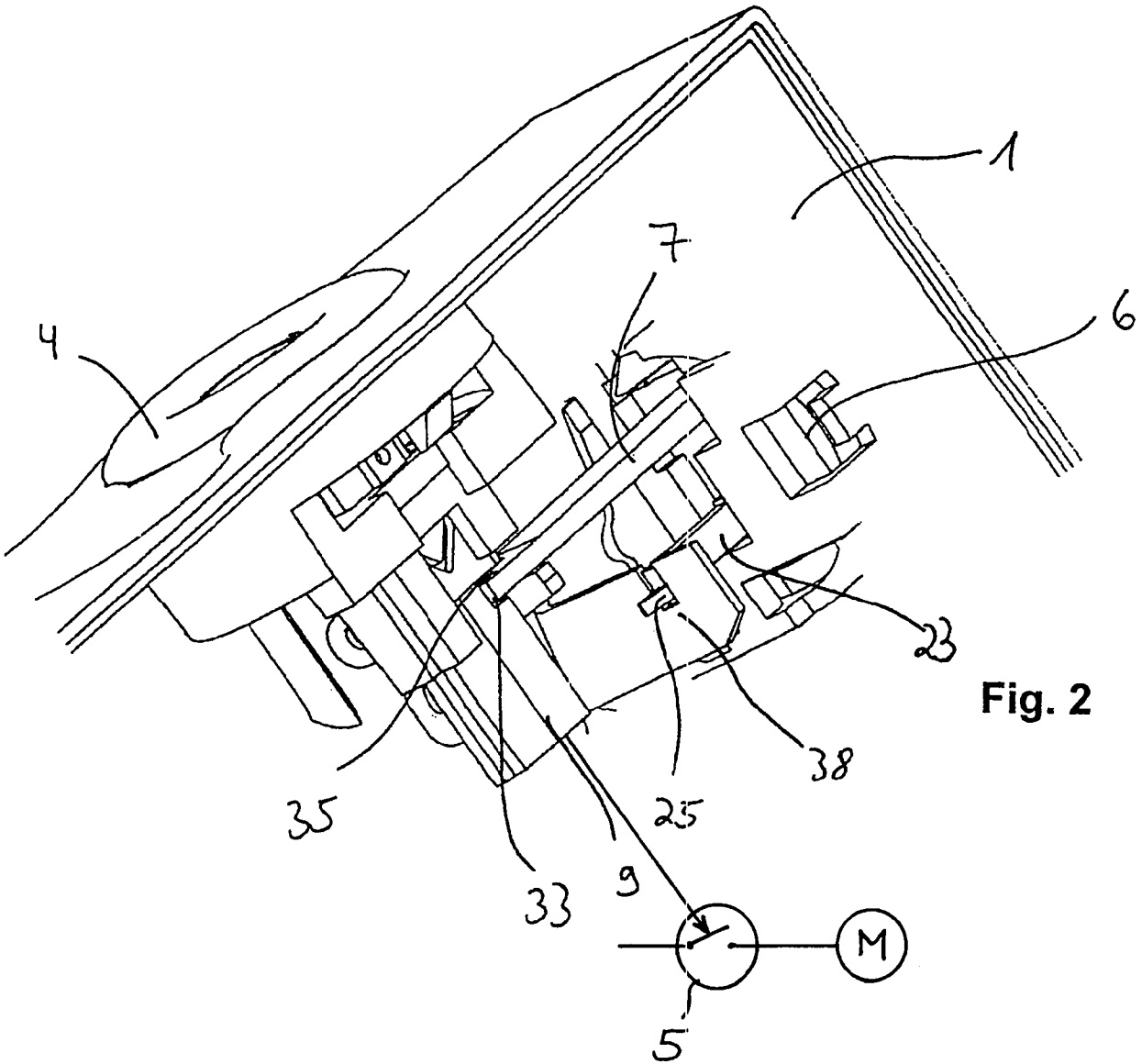
FIG. 2 is a perspective view of the switching push button and the push button lock of FIG. 1 in the pushed-in installed position.

FIG. 2 shows the first push button 4 and the second push button 6 in the position wherein they are installed in the housing 1. A second end section 25 of the second elastic spring element 23 is supported on a mating step 38, which is integrally formed on the housing 1. The lock 7 is in the form of a lever which can pivot, and which engages in a groove 33 on the guide element 9 on the stop surface 35. There is also shown an electrical switch 5 that is operated by the push button 4 and an electrical motor M to be operated by the switch 5.

Figure 3:
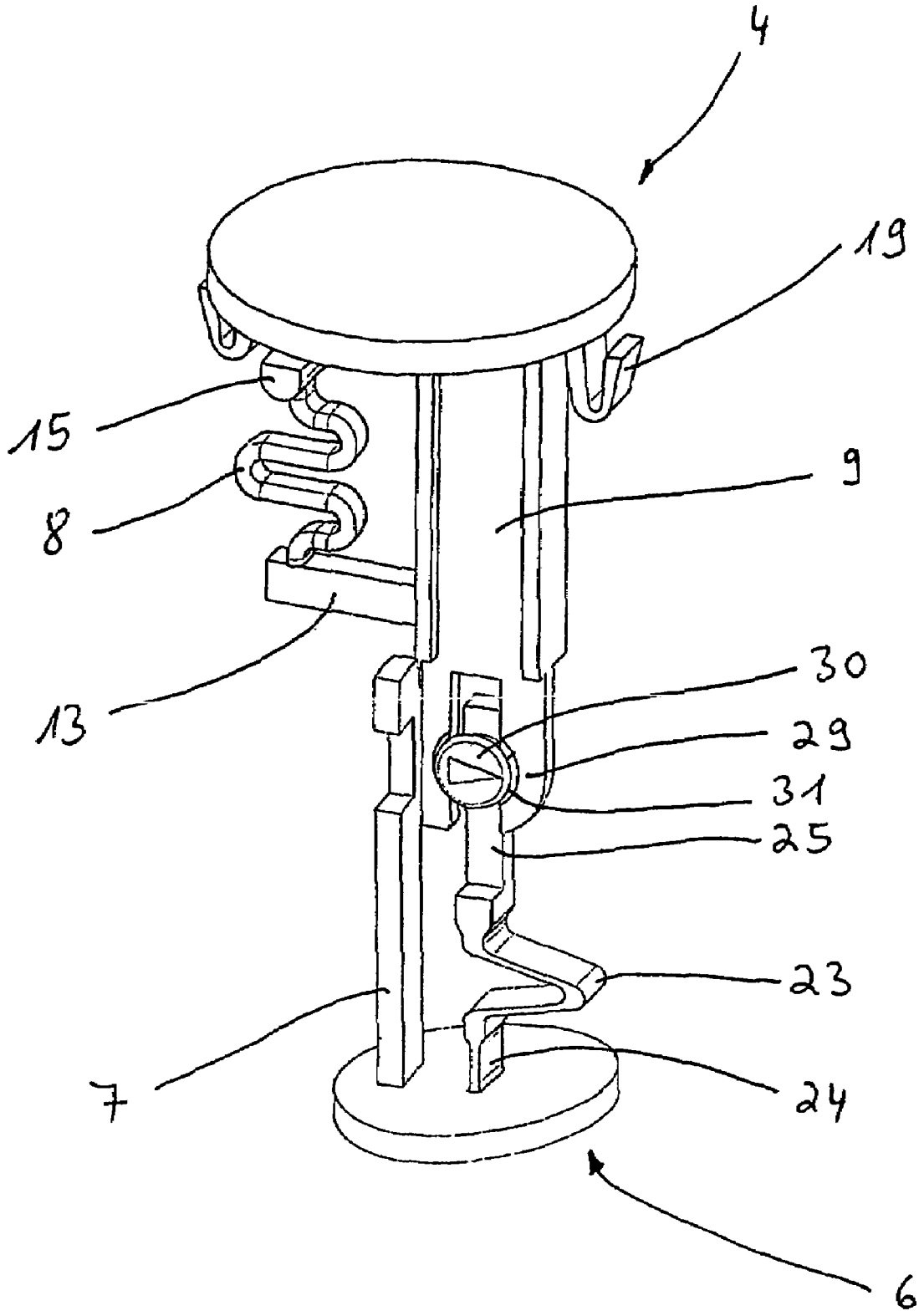
FIG. 3 is a perspective view of the integral plastic injection-molded part comprising a first push button and a second push button, before installation.

FIG. 3 shows the first push button 4 together with the second push button 6 as an integral plastic injection-molded part, in the form after its production and before assembly. The first push button 4 has an operating surface in the form of a circular disk, on whose lower face the guide element 9 is integrally formed. An elastic spring element 8 is integrally formed on the lower end 13 of the guide element 9, at a distance from the operating surface of the first push button 4. The elastic spring element 8 comprises a meandering section which is integrally formed on the end 13 of the guide element 9. The first push button 4 is produced together with the guide element 9 and the elastic spring element 8 integrally from plastic. The appropriate plastic for production of the first push button 4 may be chosen in particular with respect to the elastic characteristics of the spring element 8. The upper free end 14 of the elastic spring element 8 is in the form of a nipple 15. The nipple 15 is formed by an approximately cylindrical section at the second end 14 of the elastic spring element 8. The operating surface of the first push button 4, which is in the form of a circular disk, has two opposite latching means 19 on its lower face, which are integrally formed directly on the first push button 4. The latching means 19 are in the form of U-shaped elastic lugs, which are oriented in the form of wedges on the outer surfaces. The second push button 6 is integrally formed on the first push button 4, at the lower end of the first push button 4 and opposite it. The second push button 6 has an operating surface which is in the form of a circular disk and whose diameter is smaller than the operating surface of the first push button 4. The second elastic spring element 23 is integrally formed on the operating surface of the second push button 6, which is in the form of a circular disk, via a first end section 24, directly on the operating surface of the second push button 6. The upper free end of the second elastic spring element 23 forms the second end section 25. A cylindrical bearing journal 30 is integrally formed directly on the second end section 25. The bearing journal 30 is located concentrically in a bearing sleeve 29 of the first push button 4. The bearing journal 30 of the second push button 6 is connected to the bearing sleeve 29 of the first push button 4 via knock-out webs 31. The first push button 4 is connected to the second push button 6 as an integral plastic injection-molded part by means of the knock-out webs 31. The knock-out webs 31 are designed such that the first push button 4 and the second push button 6 can be produced in one operation in an injection mold. On the other hand, the knock-out webs 31 are designed to be sufficiently thin that the knock-out webs 31 can break through the bearing journal 30 of the second push button 6 when the second push button 6 is pivoted with respect to the first push button 4, so that the second push button 6 can be released from the first push button 4.

Figure 4:
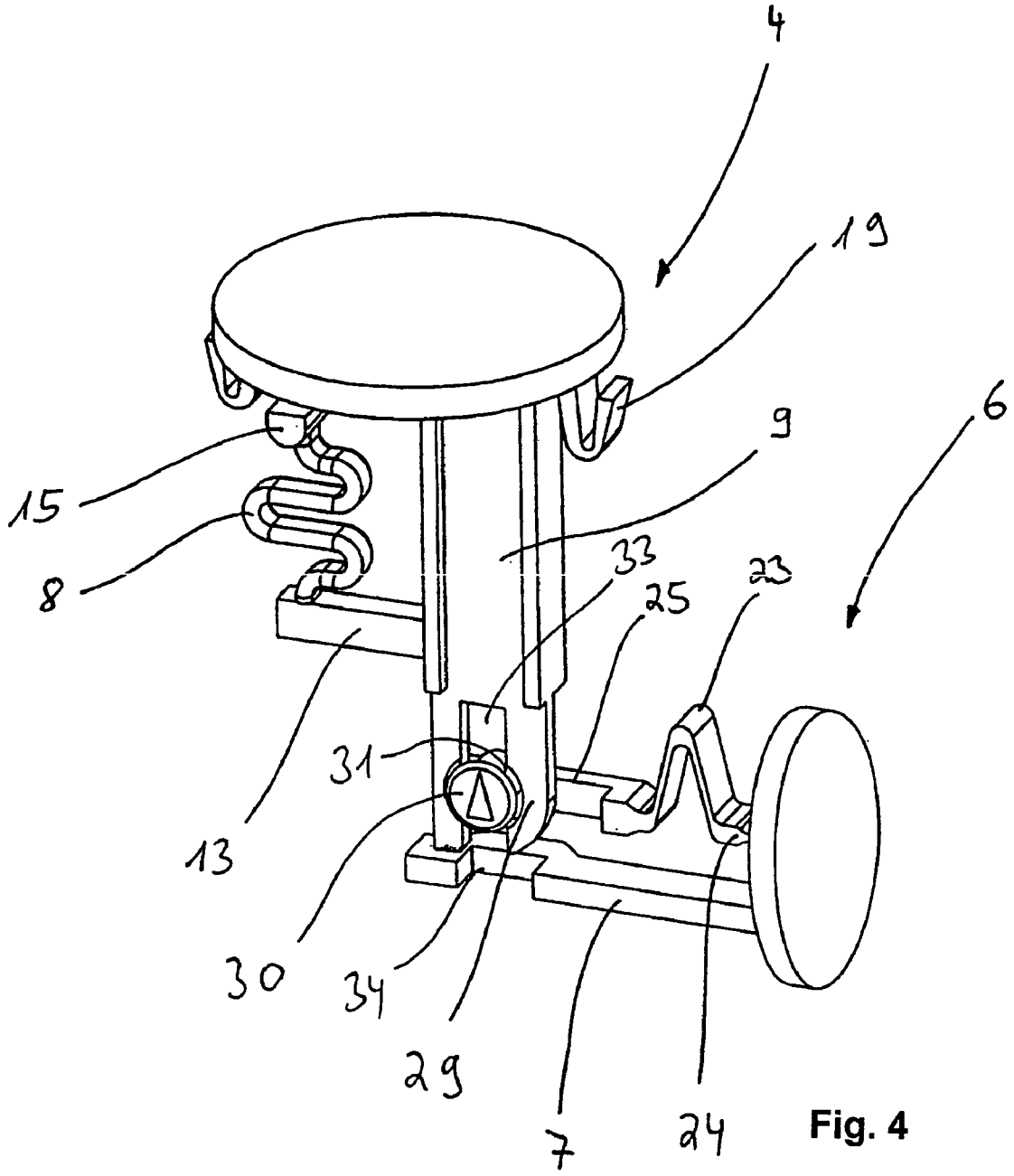
FIG. 4 is a perspective view of the two separated plastic injection-molded parts of the first push button and of the second push button, of FIG. 3, in the installed position.

FIG. 4 shows the assembly comprising the first push button 4 and the second push button 6 in a position wherein the knock-out webs 31 have been broken. The second push button 6 has been pivoted through 90° about a pivoting axis which passes through the bearing journal 30. Once the second push button 6 has been pivoted with respect to the first push button 4, the knock-out webs 31 are broken, and the second push button 6 is separated from the first push button 4. The bearing sleeves 29 of the first push button 4 holds the bearing journal 30 such that the end which is opposite the operating surface of the second push button 6 is held by the first push button 4. At the same time, the guide element 9 for the first push button 4 has a groove 33 at the free end where the bearing sleeve 29 is located. The groove 33 allows the first push button 4 to be moved downwards in the vertical direction with respect to the second push button 6. The lock 7 is integrally formed on the second push button 6, is in the form of a bolt, and has a cutout 34. When the lock 7 is in the pushed-out position, the free end of the guide element 9 for the first push button 4 can be moved vertically downwards, and the electrical switch, which is not illustrated, can be operated. When the lock 7 is in the pushed-in position, the cutout 34 on the lock 7 is offset with respect to the free end of the guide element 9 for the first push button 4 such that the free end of the guide element 9 rests against the bolt of the lock 7 thus preventing vertical movement of the first push button downwards. The electrical switch 5 therefore cannot be operated by means of the first push button 4.

Additional information concerning various specifics of a corresponding drive unit for a slicer and an exemplary household food slicer may be found, by way of example, in the commonly assigned, copending international applications PCT/EP03/01754 and PCT/EP03/01756, which are herewith incorporated by reference.

We claim:

1. A slicer, comprising: a housing, an electric drive motor for driving a cutting blade of the slicer; a first push button mounted to said housing, said first push button having a key surface for operation of an electrical switch for selectively turning on and off said drive motor, having a stop surface, and defining an operating direction with an operating axis intersecting a centroid of said key surface; a lock disposed to move between a locking position, in which said lock engages said stop surface at or in a vicinity of said operating axis and blocks said first push button for preventing an operation of said electrical switch, and an operating position in which said first push button is not blocked; and a second push button mounted to said housing and operatively connected to said lock, for selectively moving said lock into said locking position for blocking said first push button.

2. The slicer according to claim 1, wherein said stop surface of said first push button is formed on a guide element extending along said operating axis, underneath said key surface.

3. The slicer according to claim 2, wherein one face of said guide element is formed with cutout extending substantially perpendicular to said axis.

4. The slicer according to claim 2, wherein said housing is formed with a guide seat and said guide element is guided in said guide seat between a switched-on position and a switched-off position.

5. The slicer according to claim 2, which comprises a first elastic spring element having a first end attached to said guide element, and a second end supported on said housing, said first elastic spring element prestressing said first push button against said operating direction.

6. The slicer according to claim 5, wherein said first end of said first elastic spring element is integrally formed on said guide element, and said second end is formed with a nipple held in a mating piece on said housing.

7. The slicer according to claim 2, wherein said housing has a second holder for receiving therein said second push button via a second opening formed in said housing, and one of said second opening and said second push button has a step, and wherein a second elastic spring element prestresses said second push button into the pushed-in position against said step.

8. The slicer according to claim 7, wherein said first push button and said second push button are a commonly produced integral plastic injection-molding part, and knock-out webs are integrally formed between said bearing sleeve and said bearing journal.

9. The slicer according to claim 6, wherein said housing has a first holder configured for insertion of said first push button from outside said housing via a first opening formed therein, and said first push button is formed with latching means engaging behind said first opening and resting on an inner face of said housing.

10. The slicer according to claim 9, wherein said housing is formed with a guide seat and said guide element is guided in said guide seat between a switched-on position and a switched-off position, said first holder has a seating surface formed with said guide seat and said mating piece.

11. The slicer according to claim 10, wherein said mating piece is a cutout formed in said seating surface and having a size to enable said first elastic spring element to be passed through said cutout from outside, and for a cross section therof to be smaller than a cross section of said nipple.

12. The slicer according to claim 10, wherein the mating piece and said guide seat are integrally formed on the seating surface.

13. The slicer according to claim 1, wherein a second elastic spring element is integrally formed on said second push button, and is configured to prestress said second push button into a pushed-in position.

14. The slicer according to claim 13, wherein said second elastic spring element has a first end section integrally formed on said second push button.

15. The slicer according to claim 14, wherein said second elastic spring element has a second end section supported on said housing or on said guide element.

16. The slicer according to claim 13, wherein said second push button is pivotally mounted on said housing, and said lock is a lever integrally formed on said second push button and, when said second push-button is in the pushed-in position, said lever engages in a groove formed in said guide element.

17. The slicer according to claim 16, wherein one end of said guide element, disposed opposite said key surface of said first push button, is a bearing sleeve, and a second end section of said second spring element is a bearing journal.

* * * * *